US009435600B2

(12) United States Patent
Oliver

(10) Patent No.: US 9,435,600 B2
(45) Date of Patent: Sep. 6, 2016

(54) THERMAL MIRAGE REDUCTION ACCESSORY FOR FIREARMS

(71) Applicant: Russell Oliver, Sandy, UT (US)

(72) Inventor: Russell Oliver, Sandy, UT (US)

(73) Assignee: OSS Suppressors LLC, Murray, UT (US)

( * ) Notice: Subject to any disclaimer, the term of this patent is extended or adjusted under 35 U.S.C. 154(b) by 143 days.

(21) Appl. No.: 14/514,521

(22) Filed: Oct. 15, 2014

(65) Prior Publication Data

US 2016/0153734 A1 Jun. 2, 2016

Related U.S. Application Data

(60) Provisional application No. 61/891,188, filed on Oct. 15, 2013.

(51) Int. Cl.

| | |
|---|---|
| ***F41A 13/00*** | (2006.01) |
| ***F41A 21/32*** | (2006.01) |
| ***F41A 13/12*** | (2006.01) |
| ***F41A 21/44*** | (2006.01) |
| ***F41A 21/24*** | (2006.01) |

(52) U.S. Cl.

CPC ..... *F41A 21/32* (2013.01); *F41A 13/12* (2013.01); *F41A 21/24* (2013.01); *F41A 21/44* (2013.01)

(58) Field of Classification Search

CPC ..... F41A 21/32; F41A 21/24; F41A 21/44; F41A 13/12

USPC ..... 89/14.1

See application file for complete search history.

(56) References Cited

U.S. PATENT DOCUMENTS

| | | | | |
|---|---|---|---|---|
| 621,085 A * | 3/1899 | Hookham | F41A 21/24 16/DIG. 12 |
| 799,476 A * | 9/1905 | Lehmann | F41A 13/12 165/154 |
| 1,242,890 A * | 10/1917 | Sheppard | F41A 13/12 415/180 |
| 1,351,017 A * | 8/1920 | Blackmore | F41A 3/60 89/1.1 |

(Continued)

OTHER PUBLICATIONS

Sinclair Barrel Mirage Shade; http://www.sinclairintl.com/shooting_accessories/benchrest_equipment/sinclair-barrel-mirage-shade-prod327118.aspx; as accessed Aug. 15, 2013; 4 pages.

(Continued)

*Primary Examiner* — Michelle R Clement

(74) *Attorney, Agent, or Firm* — Thorpe North & Western, LLP

(57) ABSTRACT

A thermal mirage reducing device for firearms is disclosed and described. The thermal mirage reducing device includes a heat control shell oriented along a horizontal longitudinal axis corresponding to a bore line of a firearm. A cross-sectional profile of the heat control shell taken perpendicular to the longitudinal axis is asymmetrical about a vertical plane dividing the heat control shell along the longitudinal axis. The cross-sectional profile has a heat-directing portion protruding on one side of the vertical plane. The heat-directing portion extends to a high point that is vertically higher than any other point in the cross-sectional profile and laterally offset from the vertical plane. The cross-sectional profile does not intersect the line of sight of the firearm.

20 Claims, 5 Drawing Sheets

(56) References Cited

U.S. PATENT DOCUMENTS 1,789,835 A * 1/1931 Pedersen ..... F41A 21/24 165/184
1,879,603 A * 9/1932 Coupland ..... F41A 13/12 89/14.1
2,112,144 A * 3/1938 Coupland ..... F41A 13/12 42/76.02
2,287,066 A * 6/1942 Rogers ..... F41A 13/12 165/168
2,337,840 A * 12/1943 Scott-Paine ..... F41A 13/12 89/14.1
2,894,347 A * 7/1959 Woodcock ..... F41A 13/12 42/75.02
3,118,243 A * 1/1964 Manshel ..... F41A 21/02 42/76.02
3,732,642 A * 5/1973 Bray ..... F41G 11/008 42/124
3,742,640 A * 7/1973 Thomsen ..... F41A 21/02 42/76.01
4,346,643 A * 8/1982 Taylor ..... F41A 21/44 165/104.26
4,351,223 A 9/1982 Schmidt
4,424,734 A * 1/1984 Janssen ..... F41A 21/44 89/16
4,433,500 A * 2/1984 Kunevicius ..... F41A 35/02 42/74
4,536,982 A * 8/1985 Bredbury ..... F41C 23/16 42/71.01
4,638,713 A * 1/1987 Milne ..... F41A 21/44 89/14.1
4,641,567 A * 2/1987 Creedon ..... F41B 6/006 124/3
4,646,615 A * 3/1987 Gladstone ..... B29C 53/805 42/76.02
4,646,618 A * 3/1987 Kurth ..... B29C 47/0004 89/1.816
4,663,875 A * 5/1987 Tatro ..... F41C 23/16 165/134.1
4,669,212 A * 6/1987 Jackson ..... B32B 15/01 42/76.02
4,753,154 A * 6/1988 Higashi ..... F41A 21/44 165/104.26
4,762,048 A * 8/1988 Higashi ..... F41A 21/44 165/47
4,841,836 A * 6/1989 Bundy ..... F41A 21/44 89/14.1
4,982,648 A * 1/1991 Bol ..... F41A 21/24 42/76.02
5,010,676 A * 4/1991 Kennedy ..... F41C 23/16 42/71.01
H000961 H * 9/1991 Yu ..... F41H 9/06 165/154
5,062,346 A * 11/1991 Greve Hansen ..... F41A 21/44 89/14.1
5,214,234 A * 5/1993 Divecha ..... F41A 21/02 42/76.02
5,573,332 A 11/1996 Weihrich et al.
5,634,288 A * 6/1997 Martel ..... F41A 5/18 42/71.01
5,726,375 A * 3/1998 Adams ..... F41A 13/00 89/14.1
6,142,057 A * 11/2000 Schulze ..... F41A 13/12 89/14.1
6,311,602 B1 * 11/2001 Gerber ..... F41A 13/04 89/1.25
6,314,857 B1 * 11/2001 Schmidt ..... F41A 21/44 89/14.1
6,490,822 B1 * 12/2002 Swan ..... F41C 23/00 42/124
6,508,159 B1 * 1/2003 Muirhead ..... F28F 1/20 42/76.01
6,591,732 B2 * 7/2003 Gerber ..... F41A 13/04 42/90
6,679,156 B1 * 1/2004 Danou ..... F41A 5/06 89/14.1
6,836,990 B2 * 1/2005 Shiloni ..... F41G 11/003 42/75.02
7,013,592 B2 * 3/2006 Olson ..... F41B 11/00 42/76.01
7,059,076 B2 * 6/2006 Stoner ..... F41G 11/003 42/75.01
7,353,741 B2 * 4/2008 Brixius ..... F41A 13/06 42/90
7,464,496 B1 * 12/2008 Davies ..... F41A 21/24 42/75.02
7,516,690 B2 * 4/2009 McClellan ..... F41A 21/30 181/223
7,523,580 B1 * 4/2009 Tankersley ..... F41C 23/16 42/71.01
D600,827 S 9/2009 Ratanasiriwilai et al.
7,587,969 B2 * 9/2009 Silvers ..... F41A 21/34 181/223
7,594,463 B2 * 9/2009 Skinner ..... F41A 29/00 89/1.2
7,735,406 B1 * 6/2010 Olson ..... F41A 21/325 89/14.3
7,735,408 B1 * 6/2010 Becker ..... F41F 1/06 102/374
7,802,392 B2 9/2010 Peterson et al.
7,810,272 B2 * 10/2010 Brixius ..... F41A 13/06 42/72
7,963,203 B1 * 6/2011 Davies ..... F41A 3/94 42/76.02
7,997,020 B2 * 8/2011 Brixius ..... F41A 13/06 42/72
8,025,003 B1 * 9/2011 Saur ..... F41A 21/24 42/76.01
8,037,633 B1 * 10/2011 Troy ..... F41C 23/16 42/71.01
8,061,254 B2 * 11/2011 Heath ..... F41A 21/34 89/14.2
8,141,289 B2 3/2012 Gomez et al.
8,245,618 B2 * 8/2012 Emde ..... F41A 21/44 42/96
8,276,303 B2 10/2012 Kapusta et al.
8,327,572 B2 * 12/2012 Boggan ..... F41A 35/02 42/96
8,336,243 B2 * 12/2012 Langevin ..... F41C 23/16 42/71.01
8,397,615 B2 * 3/2013 Poling ..... F41A 13/12 442/136
8,438,770 B2 * 5/2013 Troy ..... F41C 23/16 42/71.01
8,516,941 B1 * 8/2013 Oliver ..... F41A 21/30 181/223
8,522,467 B1 * 9/2013 Christensen ..... F41C 23/16 42/71.01
8,528,246 B2 * 9/2013 Telles ..... F41C 23/16 42/71.01
8,578,644 B1 * 11/2013 Oquin ..... F41G 11/003 42/124
8,656,622 B2 * 2/2014 Peterson ..... F41A 11/02 42/124
8,695,475 B2 * 4/2014 Schneider ..... F41A 13/12 42/1.06
8,776,420 B2 * 7/2014 Langevin ..... F41C 23/16 42/71.01
8,782,942 B1 * 7/2014 Bentley ..... F41C 7/02 42/71.01
8,783,154 B1 * 7/2014 Windham ..... F41A 13/10 89/14.1
8,807,005 B2 * 8/2014 Moss ..... F41A 21/24 181/223
8,863,426 B1 * 10/2014 Zinsner ..... F41C 23/16 42/71.01
8,925,236 B1 * 1/2015 Mayberry ..... F41G 11/005 42/124
8,967,325 B1 * 3/2015 Cronhelm ..... F41A 13/00 181/223
9,134,092 B2 * 9/2015 Spiegelhauer ..... F41C 23/16

(56) References Cited

U.S. PATENT DOCUMENTS

| | | | | |
|---|---|---|---|---|
| 9,140,511 | B2 * | 9/2015 | Michal | F41A 21/30 |
| 9,194,652 | B2 * | 11/2015 | Esserman | F41C 23/16 |
| 9,207,031 | B2 * | 12/2015 | Balthaser | F41A 21/44 |
| 9,212,865 | B2 * | 12/2015 | Dubreuil | F41C 23/16 |
| 9,239,202 | B2 * | 1/2016 | Michal | F41A 21/24 |
| 2003/0074822 | A1 | 4/2003 | Faifer | |
| 2011/0100204 | A1 * | 5/2011 | Schlenkert | F41A 13/12 89/14.1 |
| 2011/0174141 | A1 | 7/2011 | Adolphsen | |
| 2012/0266514 | A1 | 10/2012 | Michal et al. | |
| 2014/0223793 | A1 * | 8/2014 | Peterson | F41A 11/02 42/71.01 |
| 2015/0241159 | A1 * | 8/2015 | Michal | F41A 21/44 89/14.4 |

OTHER PUBLICATIONS

Thunder Beast Arms Corp., Mirage Covers for Thunder Beast Arms Suppressors; http://thunderbeastarms.com/products/mirage-covers; as accessed Aug. 15, 2013; 2 pages.

Lilja Precision Rifle Barrels, Inc. Lilja Mirage Shield; http://riflebarrels.com/products/mirage_shield.htm; as accessed Aug. 15, 2013; 1 page.

War Sports Industries, LLC, Suppressor Sock; http://www.warsport-us.com/suppressor_sock.html; as accessed Aug. 15, 2013; 5 pages.

Rifles Only, TAB SAS—Suppressor Anti-Mirage Shield; https://www.riflesonly.com/pro-shop/tactical-gear/tab-sas-suppressor anti . . . ; as accessed Aug. 15, 2013; 3 Pages.

* cited by examiner

THERMAL MIRAGE REDUCTION ACCESSORY FOR FIREARMS

This application claims priority to U.S. Provisional Application No. 61/891,188, filed Oct. 15, 2013, which is incorporated herein by reference.

BACKGROUND

Thermal mirage effect, also called heat haze or heat shimmer, refers to the tendency of objects to appear blurry or wavy when viewed through hot air. This phenomenon is caused by differences in refractive index between hot air and adjacent cooler air. Rays of light bend when they travel through a boundary between hot and cold air, which creates a distorted image. A rising plume of hot air is in constant turbulent motion, and the boundary between the hot air and surrounding cold air is continuously shifting. This causes the image of objects viewed through a plume of hot air to move and shimmer.

Thermal mirages can be extremely problematic for firearm shooters, especially when long distance target acquisition is desired. For example, long range target shooters rely on seeing a clear picture of their targets to aim their firearms accurately. A severe thermal mirage can cause a target to appear to move and shimmer, making it almost impossible to accurately hit the target. This problem is made worse by the fact that firearms themselves can become hot enough after multiple shots to produce thermal mirage-inducing plumes of hot air from firearm barrels or suppressors. Each time a firearm fires a bullet, the explosion that propels the bullet produces heat. After repeated firing, heat generated by passage of the bullets and hot gases convectively escapes outer surfaces of the firearm and heat surrounding air. This occurs especially quickly for firearms with muzzle attachments such as sound suppressors, energy capture systems, particulate capture systems, or visual signature reducers. These attachments tend to retain heat and convert acoustic and kinetic energy into additional heat. Then, hot air from the barrel or muzzle attachment rises and creates a thermal mirage in front of the sights or optical scope of the firearm, directly in a line of sight of the firearm operator.

Insulating covers for firearm suppressors have been developed. These covers insulate the suppressor from outside air, significantly slowing rates of heat transfer to air surrounding the suppressor. This can help to reduce thermal mirage effects because the suppressor does not heat the air quickly enough to create a mirage image in front of the sights of the firearm. However, because the insulating cover traps all the heat inside, the suppressor becomes even hotter than it normally would. The rest of the firearm will also begin to heat up more, until a thermal mirage effect is eventually created from hot air rising off the uninsulated barrel of the firearm and from the insulation. Permanent damage to the firearm can also result if sufficiently high temperatures are reached.

Heat sinks have also been developed for suppressors. These increase the rate of heat transfer from the suppressor to the surrounding air, causing the suppressor to cool more quickly. Heat sinks help prevent the firearm from overheating, and they may shorten the length of time that thermal mirage effects interfere with ballistic accuracy, but such devices do not prevent thermal mirage effects while the suppressor is hot. In fact, the thermal mirage effect may tend to be more severe because the heat sink transfers heat more quickly to the surrounding air within a given time period.

SUMMARY

A thermal mirage reducing device for a firearm generally operates by directing heat asymmetrically away from the line of sight of the firearm, and thereby lessening distortion of the target image due to the thermal mirage effect. The device can include a heat control shell such as an attachable sleeve or an integrated outer housing. The heat control shell can be aligned coaxially with the bore line of the firearm. The heat control shell has a cross-sectional profile that is asymmetrical about an imaginary vertical plane running along the longitudinal axis of the heat control shell. The cross-sectional profile can generally include a core portion, through which the bore line runs, and a heat-directing portion that protrudes on one side of the vertical plane. This heat-directing portion extends to a high point that is both vertically higher than any other point in the cross-sectional profile and also laterally offset from the vertical plane. Additionally, the cross-sectional profile is shaped in such a way that it does not obstruct the line of sight of the firearm.

There has thus been outlined, rather broadly, the more important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

Figure 1:
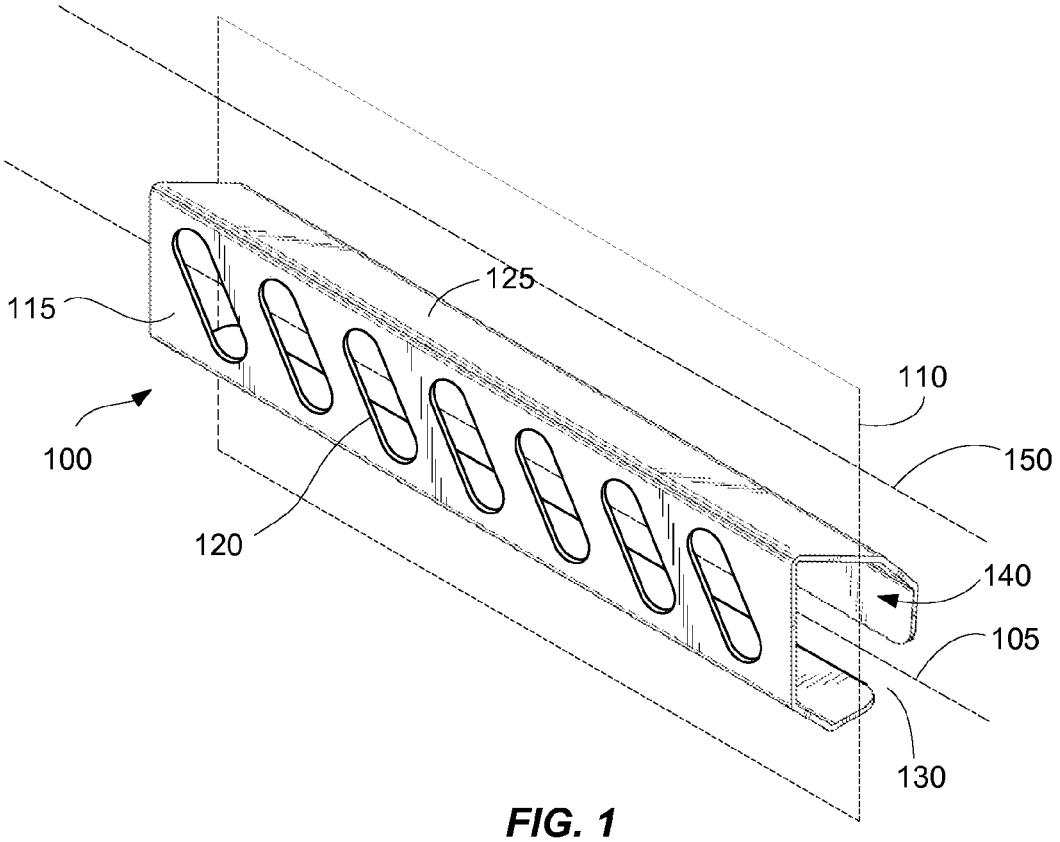
FIG. 1 is a perspective view of a thermal mirage reducing sleeve for an octagonal muzzle attachment, in accordance with an aspect of the present invention.

These drawings are provided to illustrate various aspects of the invention and are not intended to be limiting of the scope in terms of dimensions, materials, configurations, arrangements or proportions unless otherwise limited by the claims.

DETAILED DESCRIPTION

While these exemplary embodiments are described in sufficient detail to enable those skilled in the art to practice the invention, it should be understood that other embodiments may be realized and that various changes to the invention may be made without departing from the spirit and scope of the present invention. Thus, the following more detailed description of the embodiments of the present invention is not intended to limit the scope of the invention, as claimed, but is presented for purposes of illustration only and not limitation to describe the features and characteristics of the present invention, to set forth the best mode of operation of the invention, and to sufficiently enable one skilled in the art to practice the invention. Accordingly, the scope of the present invention is to be defined solely by the appended claims.

Definitions

In describing and claiming the present invention, the following terminology will be used.

The singular forms "a," "an," and "the" include plural referents unless the context clearly dictates otherwise. Thus, for example, reference to "an aperture" includes reference to one or more of such features and reference to "firing" refers to one or more such steps.

As used herein, "hot air plume" and "plume of hot air" refer to a body of hot air rising from a heated surface. It is to be understood that the temperature of the air in the plume may decrease continuously from the center of the plume outward toward the surrounding air, and therefore there may not exhibit a sharply-defined boundary between the hot air in the plume and cooler surrounding air. However, generally the plume can include any body of air that is hot enough to produce a thermal mirage effect that would interfere with the aiming of a firearm if the plume were in the line of sight of the firearm. Actual temperatures needed to produce such a plume are a function of surrounding air temperature since the mirage effect is based on temperature differentials.

As used herein, "line of sight" refers to the line along which a firearm operator would look when aiming a firearm, either across iron sights on the top of the firearm or through an optical scope mounted on the top of the firearm. The line of sight is an imaginary line that extends from an eye of the operator, through corresponding sights, and ending on the target at which the operator is aiming.

As used herein, "thermal boundary layer" refers to a layer of hot fluid formed when a hot object heats adjacent fluid and the adjacent fluid remains near the surface of the object. Usually the fluid in the thermal boundary layer flows in some direction and eventually rises away from the object in a plume. Although there may not be a sharply-defined boundary between the thermal boundary layer and the surrounding fluid (because of a continuous temperature gradient between the hot fluid and surrounding cooler fluid), for the purposes of this invention the thermal boundary layer of hot air around a thermal mirage reducing device can be considered to include any air that would be hot enough to produce a thermal mirage effect that would interfere with aiming of a firearm by reducing visual clarity along the line of sight of the firearm.

As used herein with respect to an identified property or circumstance, "substantially" refers to a degree of deviation that is sufficiently small so as to not measurably detract from the identified property or circumstance. The exact degree of deviation allowable may in some cases depend on the specific context.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a numerical range of about 1 to about 4.5 should be interpreted to include not only the explicitly recited limits of 1 to about 4.5, but also to include individual numerals such as 2, 3, 4, and sub-ranges such as 1 to 3, 2 to 4, etc. The same principle applies to ranges reciting only one numerical value, such as "less than about 4.5," which should be interpreted to include all of the above-recited values and ranges. Further, such an interpretation should apply regardless of the breadth of the range or the characteristic being described.

Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given herein.

Thermal Mirage Reducing Devices

A thermal mirage reducing device can generally operate by directing heat to one side, away from the line of sight of the firearm. Normally, a hot firearm barrel or muzzle attachment generates a plume of hot air which rises straight up from a center of the barrel or attachment, and intersects with the line of sight of the firearm. When heat produced from the barrel of a firearm or a muzzle attachment is directed to the side, the plume of hot air can rise without interfering with a view of the target. This is extremely advantageous for the firearm operator, because the thermal mirage effect can be avoided. In counter-terrorism operations, for example, this can be very helpful to snipers. Snipers must be able to shoot accurately at long range. Additionally, snipers often use muzzle attachments such as sound suppressors and visual signature reducers to avoid giving away their location. These attachments tend to give off much more heat than a rifle would on its own. Thermal mirage reducing devices are especially beneficial for snipers who need to shoot accurately despite extra heat production from muzzle attachments. Of course, these devices are also useful for competition shooters, hunters, recreational target shooters, or anyone shooting a sufficient number of rounds from a firearm to heat the firearm enough to produce thermal mirage effects.

A thermal mirage reducing device can include a heat control shell oriented along a horizontal longitudinal axis corresponding to a bore line of a firearm. The heat control shell can have a cross-sectional profile taken perpendicular to the longitudinal axis. For example, if the heat control shell is attached to a firearm, then the cross-sectional profile is the shape of the heat control shell as seen when looking straight down the barrel of the firearm. Although not required in all embodiments, the cross-sectional profile can be substantially uniform along the entire length of the heat control shell.

For example, FIG. 1 depicts a perspective view of a thermal mirage reducing sleeve 100 for an octagonal muzzle attachment. The sleeve 100 is oriented along a horizontal longitudinal axis 105, which runs through the interior space 140 of the sleeve. A line of sight 150 of a firearm runs parallel to the longitudinal axis 105 above the sleeve. An imaginary vertical plane 110, on which both the longitudinal axis 105 and the line of sight 150 lie, divides the sleeve into two sides.

Figure 2:
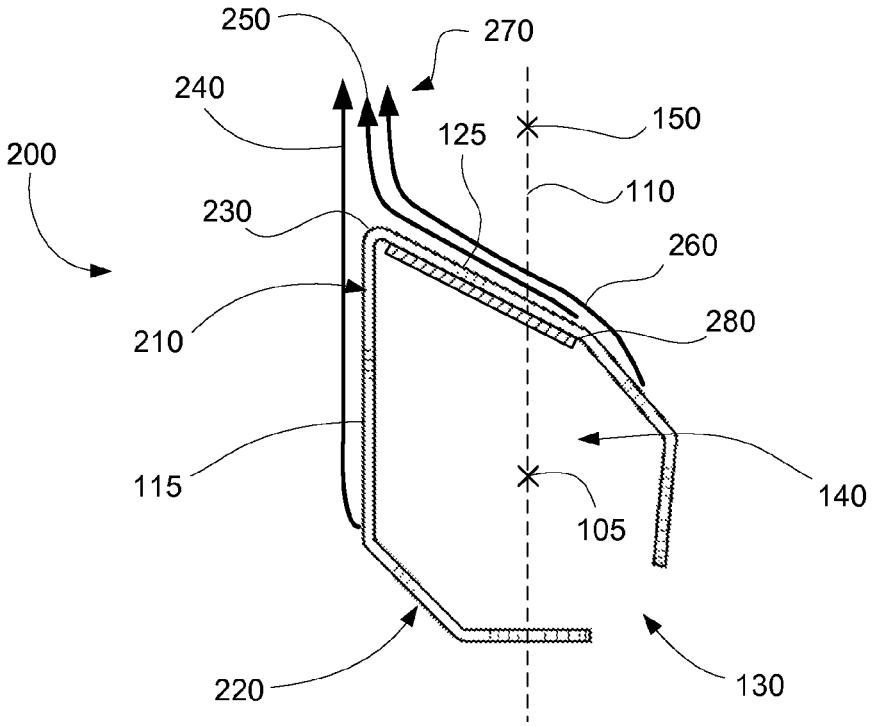
FIG. 2 is a cross-sectional profile of a thermal mirage reducing sleeve having an octagonal straight-edged teardrop profile, in accordance with an aspect of the present invention.

FIG. 2 shows the cross-sectional profile 200 of the sleeve shown in FIG. 1. In the particular embodiment depicted, the cross-sectional profile is an octagonal straight-edged teardrop profile. In any embodiment generally, the cross-sectional profile of the heat control shell can be asymmetrical about a vertical plane dividing the heat control shell along the longitudinal axis. A aspect of this asymmetry is the heat-directing portion that protrudes on one side of the vertical plane. The cross-sectional profile can include a heat-directing portion protruding on one side of the vertical plane and a core portion encompassing the longitudinal axis. The heat directing portion extends to a high point that is vertically higher than any other point in the cross-sectional profile and laterally offset from the vertical plane. This high point is the point to which the plume of hot air is drawn while rising from upper surfaces of the sleeve. Because the hot air plume rises from the high point, the high point should be sufficiently laterally offset such that the hot air plume does not intersect the line of sight of the firearm.

In some embodiments of the present invention, the cross-sectional profile is a teardrop profile wherein the high point is at the tapered tip of the teardrop. In a teardrop profile, the heat-directing portion is generally wider where adjacent the core portion of the profile, and then tapers to become narrower extending to the high point at the tip of the teardrop. The heat-directing portion generally has two edges which meet at the tip: a proximate edge and a distal edge. The proximate edge is an edge nearer to the line of sight of the firearm. This is generally the upper edge of the heat-directing portion, which comprises the upper edge of the cross-sectional profile. Although the proximate edge can have a variety of shapes, at some point the proximate edge slopes upward to the high point at the tip of the teardrop profile. The distal edge is an edge of the heat-directing portion which meets the proximate edge at the tip of the tapered teardrop. The distal edge is farther from the line of sight of the firearm than the proximate edge. In some embodiments, the distal edge is a straight vertical edge running down from the tip of the teardrop to the core portion of the profile. In other embodiments, the distal edge can be angled off of vertical so that the distal edge is closer to or farther from the proximate edge. The distal edge can also include curves or other shapes depending on the design of the profile.

FIG. 2 shows a front end view of the octagonal straight-edged teardrop profile of FIG. 1. In this profile, the core portion 220 of the profile is shaped to create an interior space 140 that conforms to an octagonal muzzle attachment. The core portion 220 encompasses the longitudinal axis 105. Heat directing portion 210 extends on one side of the vertical plane 110 to a tapered tip which is also the highest point 230 of the profile. A distal surface 115 runs down vertically from the high point to the core portion. The distal face is often flat or straight, although concave and/or convex contours can be included along the distal face. The proximate face 125 is shown as a straight edge sloping from the high point toward the vertical plane and connecting with the core portion. As seen in the figure, the proximate face is nearer to the line of sight 150 than is the distal face. Generally, the proximate face can be the edge of the profile that is nearest to the line of sight.

The cross-sectional profile can be designed to have effective convective heat transfer properties to avoid thermal mirage effects. However, modeling convective heat transfer from an object to a surrounding fluid can be a complex problem. The rate of heat transfer and the temperature profile of the fluid depend on many factors, including the geometry of the object, the viscosity and density of the fluid, heat capacities and thermal conductivities of both the object and the fluid, radiation of heat from a surface, and other factors. Correlations have been developed for convective heat transfer from objects with simple geometries, such as spheres, cylinders, and flat plates. However, for more complex objects such as the thermal mirage reducing devices of the present invention, numerical methods can be used to predict heat transfer rates and temperature profiles.

In general, convective heat transfer involves flowing fluids. A specific type of convection occurs when the density of a fluid changes with temperature. Usually the fluid becomes less dense as its temperature rises, making the fluid more buoyant. The less dense fluid will then rise while denser fluid flows down in its place. This type of convection, where the motion of fluid is induced by a temperature change of the fluid, is known as "natural convection." Natural convection occurs when a hot object is surrounded by a cooler fluid. Heat from the object is transferred to the adjacent fluid, whereby the fluid is heated and becomes less dense. The heated fluid tends to flow upward while cooler fluid flows toward the object to take its place.

However, heated fluid cannot immediately move straight upward and away from the object because cooler fluid is in the way. Instead, the heated fluid forms a thermal boundary layer in which it tends to remain near to the surface of the object for a time until finally forming a plume of hot fluid that flows upward from the object. The shape and thickness of the thermal boundary layer depends on the geometry of the object, viscosity of the fluid, and various other factors that affect convective heat transfer. Generally, when a thermal boundary layer forms on an inclined surface, the thermal boundary layer at least partially conforms to the shape of the surface at least along a partial length of the surface. Thermal boundary layer adherence also depends on the angle of inclination of the surface. The inclined surface transfers heat to the fluid in contact with the surface. The heated fluid tends to rise because of its increased buoyancy, but it also tends to remain close to the surface because cooler fluid above is not immediately displaced. Therefore, instead of rising straight up, the heated fluid flows along the slope of the inclined surface. In this way the fluid can rise upward in the vertical direction while still staying close to the surface. Thus the direction of flow within the thermal boundary layer has a vertical and a horizontal component. The thermal boundary layer can become thicker farther up the slope of the surface because more heated fluid accumulates as it flows up the slope. Eventually, the heated fluid can split off into a plume that rises straight upward, free from the surface. The distance that the heated fluid will flow before splitting off into a plume is dependent on the geometry of the surface and other factors involved in convective heat transfer.

In the case of the present invention, a hot thermal mirage reducing device can be surrounded by cooler air. The device transfers heat to air that is adjacent to the surface of the device during use. The heated air then becomes less dense and forms a thermal boundary layer near the surface. The shape of the boundary layer depends on the geometry of the device, but generally the boundary layer can extend around the exterior surface of the device until forming a hot air plume which rises from the device.

FIG. 2 shows flow profile lines 240, 250, 260 representing the flow of hot air off of a thermal mirage reducing sleeve. A corresponding temperature profile of the air around the cross-sectional profile 200 shown in FIG. 2 illustrates that the hottest temperatures are located near the high point 230, where the flow profile lines 240, 250 and 260 converge into a hot air plume 270. When the sleeve heats adjacent air, the hot air forms a thermal boundary layer along the upper proximate surface 125 where hot air is flowing from the core portion 220 of the cross-sectional profile. During normal use, the thermal boundary layer around the sleeve is thinner near the underside of the sleeve, and then thickens toward the tapered tip.

In one alternative aspect, an optional insulator layer 280 can be disposed on an underside of the proximate surface 125. Generally, the insulator layer can be located on an inside surface of the heat control shell above the longitudinal axis such that heat transfer directed along plane 110 can be reduced. The insulator layer can extend a majority length of the sleeve and in most cases substantially an entire length of the sleeve. Similarly, the insulator layer can extend a width of the proximate surface. The insulator layer can further reduce heat dissipation from the proximate surface. As a general guideline the insulator layer can be from about 0.5 mm to about 5 mm in thickness, although other thicknesses can be suitable depending on the material and desired performance. Non-limiting examples of suitable material for the insulator layer can include silicone, silicone composites, fiberglass composites, carbon fiber, and the like. Such materials can also be provided as sheets, foams, sponges, or the like. The sheets can be adhered, sprayed or otherwise affixed to the underside. Commercially suitable insulator materials can include, but are not limited to, COHRLASTIC silicones, BELLOFOAM silicones, Grainger Silicone Rubber sheets, and the like.

Although there may not be a sharply-defined boundary between the thermal boundary layer and the surrounding air, for the purposes of this invention the thermal boundary layer can include any air that would be hot enough to produce a thermal mirage effect that interferes with aiming of a firearm if in the line of sight of the firearm. As shown in FIG. 2, the proximate face 125 is closest to the line of sight 150. This proximate face defines and directs a thermal boundary layer away from the line of sight 150 so that the thermal boundary layer 260 does not intersect the line of sight 150. The particular design of the proximate face depicted in FIG. 2 is but one example of a design that can successfully direct hot air away from the line of sight so that thermal mirage effects are reduced. The design of the proximate edge is not the only relevant factor. The entire cross-sectional profile can affect the shape of the thermal boundary layer around a thermal mirage reducing device. Many cross-sectional profile designs can be suitable for directing the thermal boundary layer away from the line of sight. As stated above, predicting convective heat flow around a complex object is a challenging task. This disclosure will outline several specific designs that have been tested using numerical methods to achieve the desired redirected thermal boundary layers.

Numerical method calculations using computer models were used to confirm convective redirection performance of several cross-sectional profiles that can significantly reduce thermal mirage effects. One such profile is shown in FIG. 2, which depicts the cross-sectional profile 200 as an octagonal straight-edged teardrop profile. The proximate face 125 slopes up to meet the distal face 115 at the high point 230. As shown in this figure, the tip of the teardrop shape at the high point is a slightly rounded corner. This is at least partially a result of manufacture which can include bending of sheet material. Consequently, tapered tip profiles could vary when using other manufacturing options (e.g. machining, molding, etc). Depending on the design and method of manufacture of a thermal mirage reducing device, the tapered tip can be other shapes as well, such as a sharp corner, a horizontal edge, or a more rounded edge. The particular embodiment in FIG. 2 is a sleeve that is manufactured by cutting a sheet of material and longitudinal bending into the final shape. The illustrated distal face is vertical, and the proximate face meets the distal face at an acute angle such that the proximate face slopes downward away from the high point. This angle can generally be about 40° to about 75°, although about 63° works particularly well.

Figure 3A:
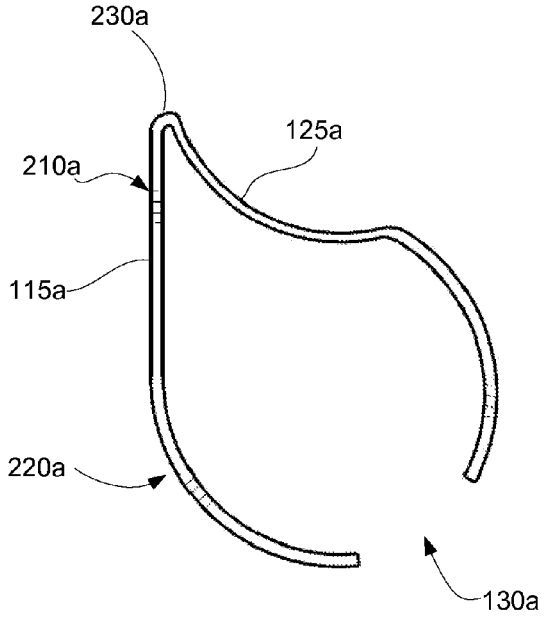
FIG. 3A is a cross-sectional profile of a thermal mirage reducing sleeve having a circular arcuate teardrop profile, in accordance with an aspect of the present invention.

Suitable cross-sectional profiles can vary considerably as long as the offset thermal convection is maintained. FIG. 3A shows a cross-sectional profile of a sleeve with a circular arcuate teardrop shape. This sleeve is designed to attach to a cylindrical muzzle attachment such as conventional suppressors. Accordingly, the core portion 220*a* of the cross-sectional profile is circular. The heat-directing portion 210*a* includes a vertical distal surface 115*a* that extends from the tip 230*a* of the teardrop downward to the core portion, and a proximate face 125*a* that meets the distal face at an acute angle at the tip. The proximate face is arcuate such that the proximate edge is concave and recessed toward the distal face. A longitudinal slot 130*a* can run a length of the sleeve to allow slight bending which facilitates frictional engagement with the muzzle attachment.

Figure 3B:
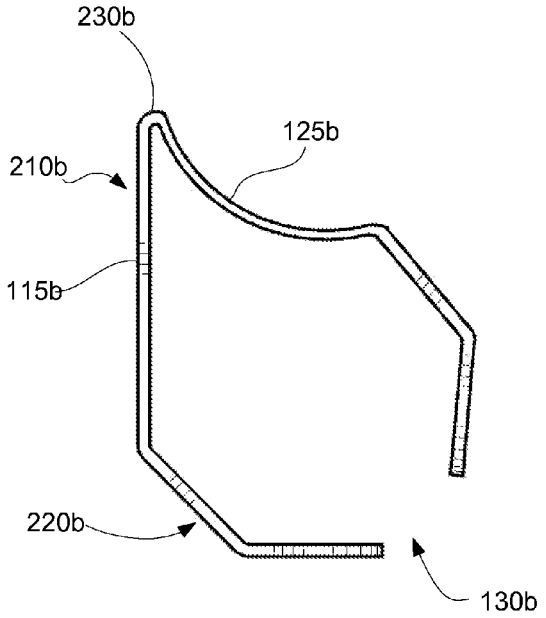
FIG. 3B is a cross-sectional profile of a thermal mirage reducing sleeve having an octagonal arcuate teardrop profile, in accordance with an aspect of the present invention.

FIG. 3B shows a cross-sectional profile of a sleeve with an octagonal arcuate teardrop shape. This sleeve is designed to attach to an octagonal muzzle attachment such that the core portion 220*b* of the cross-sectional profile is octagonal. The heat-directing portion 210*b* includes a vertical distal face 115*b* that extends from the tip 230*b* downward to the core portion 220*b*. A proximate face 125 meets the distal face at an acute angle at the tip. In this profile, the proximate face is arcuate such that the proximate face is concave toward the distal face.

Figure 3C:
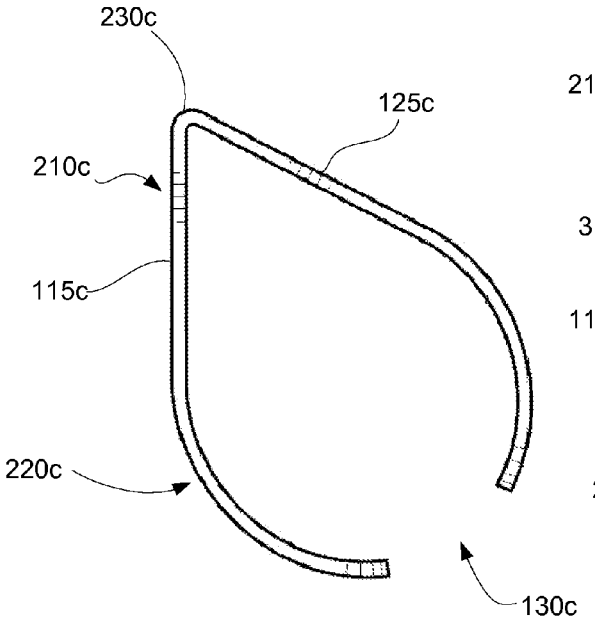
FIG. 3C is a cross-sectional profile of a thermal mirage reducing sleeve having a circular straight-edged teardrop profile, in accordance with an aspect of the present invention.

FIG. 3C shows a cross-sectional profile of a sleeve with a circular straight-edged teardrop shape. This sleeve is designed to attach to a cylindrical muzzle attachment, so the core portion 220*c* of the cross-sectional profile is circular. The heat-directing portion 210*c* includes a vertical face 115*c* that extends from the tip 230*c* downward to the core portion. A straight proximate face 125*c* meets the distal face at an acute angle at the tip. The proximate face is substantially straight running from the tapered tip of the teardrop at the tip to the core portion.

Figure 3D:
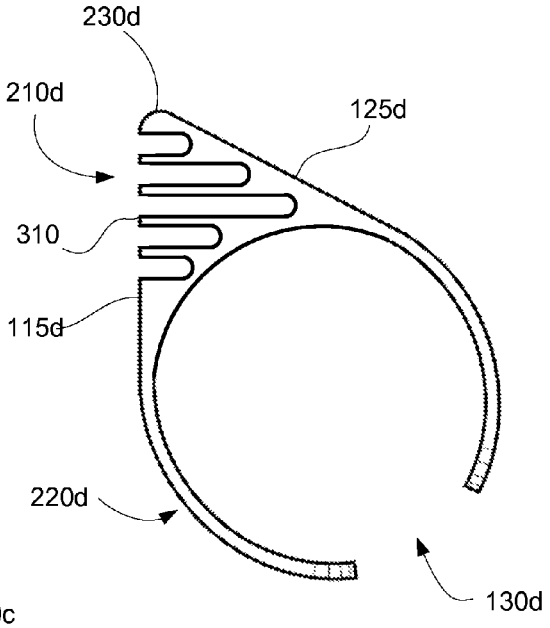
FIG. 3D is a cross-sectional profile of a thermal mirage reducing sleeve having a plurality of heat transfer fins, in accordance with an aspect of the present invention.

FIG. 3D shows a cross-sectional profile of a sleeve with a circular straight-edged teardrop shape and heat transfer fins 310 integrated along the distal face 115*d*. As with the configuration illustrated in FIGS. 3A and 3C, this sleeve is designed to attach to a cylindrical muzzle attachment. Thus, the core portion 220*d* of the cross-sectional profile is circular. The heat-directing portion 210*d* includes a distal face with integrated heat transfer fins, and a straight proximate face 125 that meets the distal face at an acute angle at the tip 230*d*. The proximate face is substantially straight running from the tapered tip of the teardrop to the core portion. The heat transfer fins increase the rate of heat transfer from the sleeve to the air, thereby allowing the sleeve and the muzzle attachment to cool more quickly.

Each of the above embodiments is an example of a thermal mirage reducing device that can effectively direct hot air away from the line of sight of a firearm to reduce thermal mirage effects. Other cross-sectional profile designs can also be suitable, as long as they conform to the general design principles as described herein with respect to the explicitly disclosed embodiments. A cross-sectional profile can be asymmetrical and designed to direct hot air to one side so hot air does not rise in front of the line of sight of the firearm sufficient to distort target and/or sighting mechanisms. At the very least, this can be accomplished by designing the cross-sectional profile with a high point on one side of the cross-sectional profile, which is vertically higher than any other point in the cross-sectional profile. This high point is the point from which a hot air plume will rise, so the high point can be laterally offset from the line of sight such that the hot air plume will not intersect the line of sight. Numerical method calculations were used to predict temperature profiles for various cross-sectional profiles, and have confirmed that asymmetrical profiles are more effective than tested symmetrical profiles. Profiles with a flat upper edge or a symmetrically rounded upper edge result in a hot air plume rising from the center of the profile, and directly intersecting with the line of sight. Symmetrical profiles with two high points, one on either side of the line of sight, were also tested. Although this type of profile formed two separate hot air plumes at the two high points, the plumes were not as well defined and they converged into a single plume after rising only a short distance.

As discussed above, the design of the proximate face of a cross-sectional profile can be important. This face surface is closest to the line of sight and can be designed so that the thermal boundary layer conforms to the proximate face and does not intersect the line of sight. Generally, smooth proximate edges, without protrusions or peaks to interrupt the flow in the thermal boundary layer, are effective. If the proximate edge has protrusions or peaks, even if the protrusions or peaks are lower than the high point of the cross-sectional profile, then the protrusions or peaks can interrupt the thermal boundary layer and cause plumes to form closer to the center of the profile where they may intersect the line of sight. However, small peaks or protrusions will not always interrupt the thermal boundary layer. As seen in FIG. 3A-3B, an arcuate shaped proximate edge can be effective. These figures show a slight peak where the proximate face meets the core portion at a bend in the material sheet from which the sleeve is manufactured. This slight peak does not interfere with the thermal redirection operation of the sleeve. However, excessive accentuation of the slight peak or a more pronounced arc could interrupt the thermal boundary layer.

The distal face can generally be configured more freely than the proximate face. Protrusions or irregular shapes on the distal face will generally not produce plumes that would intersect the line of sight, because the distal edge is already laterally offset from the line of sight. With that said, it can be advantageous to have a smooth distal edge such as the vertical distal face in FIG. 2 and FIG. 3A-3C because the thermal boundary layer on the distal edge can be unobstructed and can result in a faster-flowing plume which in turn can help to draw in hot air from the proximate edge. However, in some embodiments the distal edge can include heat transfer fins, as shown in FIG. 3D, or other heat dissipation features. The distal face 115*d* depicted in this figure is recessed so that the distal edge includes a plurality of heat transfer fins 310. On a thermal mirage reducing device with this cross-sectional profile, the distal edge of the profile corresponds to a distal face of the device. The recesses in the distal edge of the profile extend along the length of the device, creating a plurality of heat transfer fins on the distal face, aligned horizontally. In other embodiments, the distal face can include vertical heat transfer fins. The heat transfer fins can be formed by recesses in the distal face, or the heat transfer fins can protrude from the distal face. Heat transfer fins increase the surface area of the thermal mirage reducing device, thereby increasing the rate of heat transfer from the device to the surrounding air. This allows the device and the firearm associated with the device to cool more quickly. While heat transfer fins transfer heat more quickly to the air, and thus can possibly create a larger or hotter hot air plume, the hot air plume will not intersect the line of sight of the firearm because the heat transfer fins on the distal face are laterally offset from the line of sight.

In some embodiments, the distal face can also include a plurality of convective heat apertures into an interior space of the heat control shell. If the heat control shell is an attachment for a firearm barrel or muzzle attachment, then convective heat apertures can help the firearm barrel or muzzle attachment cool down faster by transferring heat directly to the air by convective heat transfer. The sleeve depicted in FIG. 1 includes convective heat apertures 120 into the interior space 140 of the sleeve. The convective heat apertures are openings that allow air to move from the interior space to the exterior of the sleeve. The shape, size, number, and placement of the convective heat apertures can vary. For example, apertures can be elongated rod shaped, elliptical, circular, slotted, squared, rectangular, and the like, although other shapes can also be suitable. In the particular embodiment depicted in FIG. 1, the convective heat apertures can be useful for allowing air to come in direct contact with the octagonal muzzle attachment inside the sleeve. Also, in this particular embodiment, hot air can be trapped above the octagonal muzzle attachment in the empty space inside the heat-directing portion. The convective heat apertures allow this hot air to escape out through the distal face, as opposed to conductive heat transfer through the sleeve thickness before heat convectively escapes to surrounding air.

Although several embodiments of thermal mirage reducing devices with teardrop shaped cross-sectional profiles have been discussed, other cross-sectional profiles can also be suitable. Profiles that are not teardrop shaped, i.e., in which the heat-directing portion does not taper to a tip, can effectively direct hot air away from the line of sight and reduce thermal mirage effects. The same general design principles should apply to any cross-sectional profile. The profile can be asymmetrical with a high point on one side that is laterally offset from the line of sight. Also, the edge of the cross-sectional profile that is nearest to the line of sight can be designed so that the thermal boundary layer does not intersect the line of sight.

A heat control shell in accordance with certain embodiments of the present invention can be adapted to be removably attachable to a firearm barrel or muzzle attachment. In some embodiments, the heat control shell can be configured in size and shape to form a friction fit with a firearm barrel or muzzle attachment. For example, a heat control shell in some embodiments can be a sleeve that slides over a muzzle attachment or firearm barrel and is held in place by friction fit. In other embodiments, the heat control shell can attach to the muzzle attachment or firearm barrel by other means, such as detents, locking pins, latches, threaded couplings, ties, straps, and so forth.

As discussed previously, the heat control shell can define an interior space as shown in FIG. 1 and FIG. 2. The thermal mirage reducing sleeve depicted has an interior space 140 shaped to receive an octagonal muzzle attachment. Also, the sleeves depicted in FIGS. 3A, 3C, and 3D define an interior space shaped to receive a cylindrical muzzle attachment. The interior space does not necessarily conform entirely to the shape of the muzzle attachment or firearm barrel to which the heat control shell will be attached. However, the interior space can be configured to engage with a corresponding muzzle attachment or barrel. In embodiments that attach to a firearm barrel or muzzle attachment through friction fit, the interior space of the heat control shell can come in contact with the outer surface of the firearm barrel or muzzle attachment in multiple locations so that the heat control shell can be held in place by friction.

In some embodiments, a heat control shell can include a slot running substantially parallel to the longitudinal axis along an entire length of the heat control shell. The slot can be oriented remote from the heat-directing portion of the heat control shell. A slot remotely oriented from the heat-directing portion is less likely to interfere with the thermal boundary layer around the heat directing portion. Also, a remote slot can allow the firearm barrel or muzzle attachment within the heat control shell to transfer heat directly to the air through convective heat transfer, without creating a hot air plume that would intersect the line of sight of the firearm. In some embodiments, the slot can be located on the opposite side of the heat control shell from the heat-directing portion. As seen in FIGS. 3A, 3B, 3C, and 3D, the slot 130*a-d* can be opposite from the high point 230 across the core portion 220. The sleeve shown in FIG. 2 includes a slot 130 that is oriented nearly opposite from the high point 230 across the core portion 220. In this embodiment, the sleeve is configured to slide over an octagonal muzzle attachment.

The sleeve can be manufactured by bending a sheet of material into the shape of the cross-sectional profile 200. The sleeve as depicted is bent at angles that make the interior space 140 slightly smaller than a regular octagon shaped muzzle attachment. However, the sleeve can elastically deform slightly so that the sleeve can slide over the muzzle attachment. When the sleeve is elastically deformed in this way, pressure is placed on the muzzle attachment so that a friction fit is formed. The slot 130 allows the sleeve to elastically bend in this way by becoming slightly wider when the sleeve bends to fit over the muzzle attachment.

Figure 7:
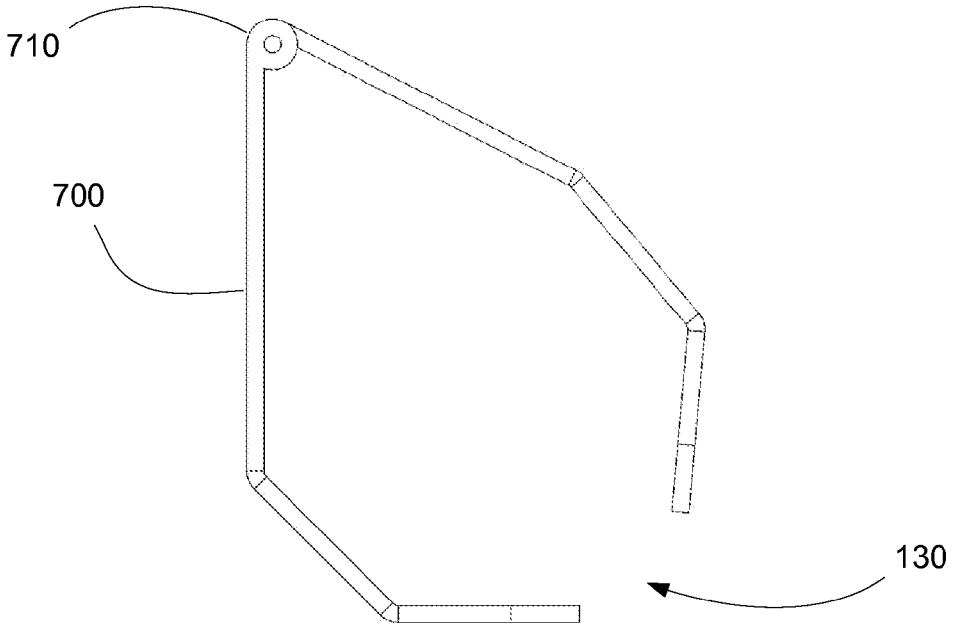
FIG. 7 is a cross-sectional profile of a hinged thermal mirage reducing sleeve in accordance with an aspect of the present invention.

In some embodiments, a heat control shell can include a hinge to allow the heat control shell to be opened and attached to a firearm barrel or muzzle attachment without requiring the shell to be slid along the length of the barrel or muzzle attachment. In one exemplary embodiment, shown in FIG. 7, a hinged heat control shell 700 can have a hinge 710 at the high point of the cross sectional profile. The hinge can rotate, opening the heat control shell to allow the shell to be placed around a firearm barrel or muzzle attachment. The hinged joint can extend longitudinally along the sleeve. Then the hinge can rotate closed to attach the shell to the barrel or muzzle attachment. In some embodiments, a hinged heat control shell can have a slot 130 oriented nearly opposite the high point as shown in the figure. However, in other embodiments, a hinged heat control shell can include one or more closures such as latches, straps, ties, locking pins, and so forth, to hold the hinged heat control shell closed when it is attached to a firearm.

Figure 8:
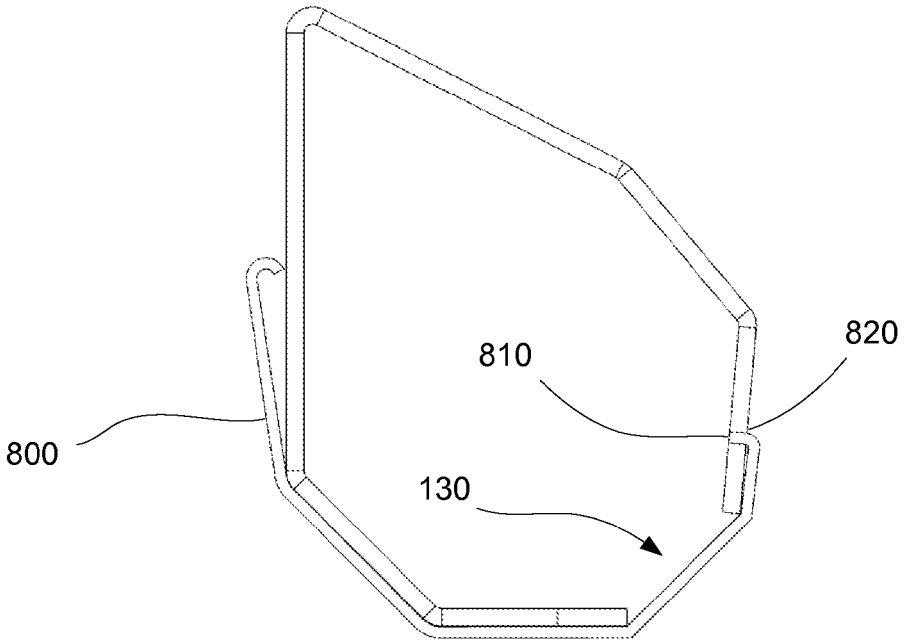
FIG. 8 is a cross-sectional profile of a thermal mirage reducing sleeve with an attached retention clip in accordance with an aspect of the present invention.

A thermal mirage reducing device can optionally include one or more retention clips that can attach to the heat control shell and squeeze the heat control shell to promote a friction fit between the heat control shell and a firearm barrel or muzzle attachment. As shown in FIG. 8, a retention clip 800 can clip onto the heat control shell and retain the heat control shell on the firearm barrel or muzzle attachment. In one embodiment, the retention clip can include a catch 810 that fits into a notch 820 in the heat control shell. The notch can be segmented at one or more spots or run longitudinally along the sleeve. However, in other embodiments, the retention clip can use any other means of attaching to the heat control shell, such as interference fitting, detents, latches, and so forth. The retention clip can be shaped in such a way that the retention clip elastically flexes to fit around the heat control shell, so that tension in the retention clip causes the retention clip to exert pressure on the heat control shell. In this way the retention clip can squeeze the heat control shell more tightly against the firearm barrel or muzzle attachment. Also, when the heat control shell has a slot 130, the retention clip can prevent the slot from widening and loosening the fit of the heat control shell over the firearm barrel or muzzle attachment. The retention clip can typically be formed by cutting sheet material, such as aluminum sheet, to the appropriate shape and then bending the sheet material into the shape of the retention clip. In some cases the retention clip can be long enough to extend along the entire length of the heat control shell. In other cases, the retention clip can be shorter, such as 1-2 cm in length, and multiple retention clips can be attached along the length of the heat control shell.

In some embodiments, the thermal mirage reducing device can be rotated to adjust for non-vertical use of the firearm. Normally a firearm is held with the top of the firearm up and the bottom down. However, in some situations a shooter might desire to hold the firearm at a tilted angle. In these situations, the thermal mirage reducing device can be rotated so that the hot air plume rises where it will not intersect the line of sight of the firearm. For example, a sleeve with a circular profile as depicted in FIGS.

3A, 3C, and 3D can be easily rotated around a muzzle attachment to any angle. For example, an octagonal sleeve, as depicted in FIG. 2 or FIG. 3B, can be easily removed from the muzzle attachment and then reattached at another angle in any increment of 45°. Rotating a thermal mirage reducing device can also be useful when wind would blow the hot air plume across the line of sight of the firearm. Also, the thermal mirage reducing device can be reversible (i.e. the device can be axially symmetric while being radially asymmetric). Thus, any of the sleeves depicted in FIG. 2 and FIG. 3A-3D can be removed, turned around, and reattached in the reverse direction so that the heat-directing portion is on the opposite side.

Although several embodiments of removably attachable thermal mirage reducing devices have been discussed, the thermal mirage reducing device can also be integrated with a firearm barrel or muzzle attachment. For example, in one embodiment a thermal mirage reducing device can be an integrated outer housing of a muzzle attachment. Regardless of whether the thermal mirage reducing features are removable or integrated, the muzzle attachment can be a sound suppressor, energy capture system, particulate capture system, visual signature reducer, gas control mechanisms, or other muzzle attachments. In one particular embodiment, the thermal mirage reducing device can be the outer housing of a modular system that can contain one or more of a sound suppressor module, energy capture module, particulate capture module, visual signature reducer module, and other internal modules.

The heat control shell can typically be a rigid material such as a metal or carbon fiber composite material, although other rigid materials can be used. A thermal mirage reducing device in accordance with the present invention can generally include a thermally conductive material having a high thermal conductivity. Non-limiting examples of suitable materials include aluminum, steel, copper, carbon fiber, composites thereof, alloys thereof, and mixtures thereof. Other materials with high thermal conductivities can also be used. For the purposes of the invention, a high thermal conductivity can be considered to be any thermal conductivity over about 50 $W \cdot m^{-1} \cdot K^{-1}$, and in some cases greater than 100 $W \cdot m^{-1} \cdot K^{-1}$. High thermal conductivity materials are advantageous because they allow the thermal mirage reducing device to quickly conduct heat away from the firearm barrel or muzzle attachment and transfer the heat to the air.

Metals such as aluminum, stainless steel, and copper are also advantageous because they are readily available, easily worked and can be used to easily manufacture thermal mirage reducing devices. For example, the sleeve depicted in FIG. 1 is manufactured by cutting a sheet of aluminum into a flat preform and then bending the flat preform to match the cross-sectional profile as shown in FIG. 2. The rounded corners adjacent to the slot 130 can be cut as part of the preform cutting process, and the convective heat apertures 120 can also be punched during perform cutting. The elastic flexibility of aluminum also allows the sleeve to bend slightly when it is attached to a muzzle attachment so that it can form a friction fit. An aluminum sheet for manufacturing a sleeve in this way can be any suitable thickness. Generally, sleeve thickness can range from about 1/32 inch to about 1/8 inch, and in some cases is about 1/16 inch.

Figure 4A:
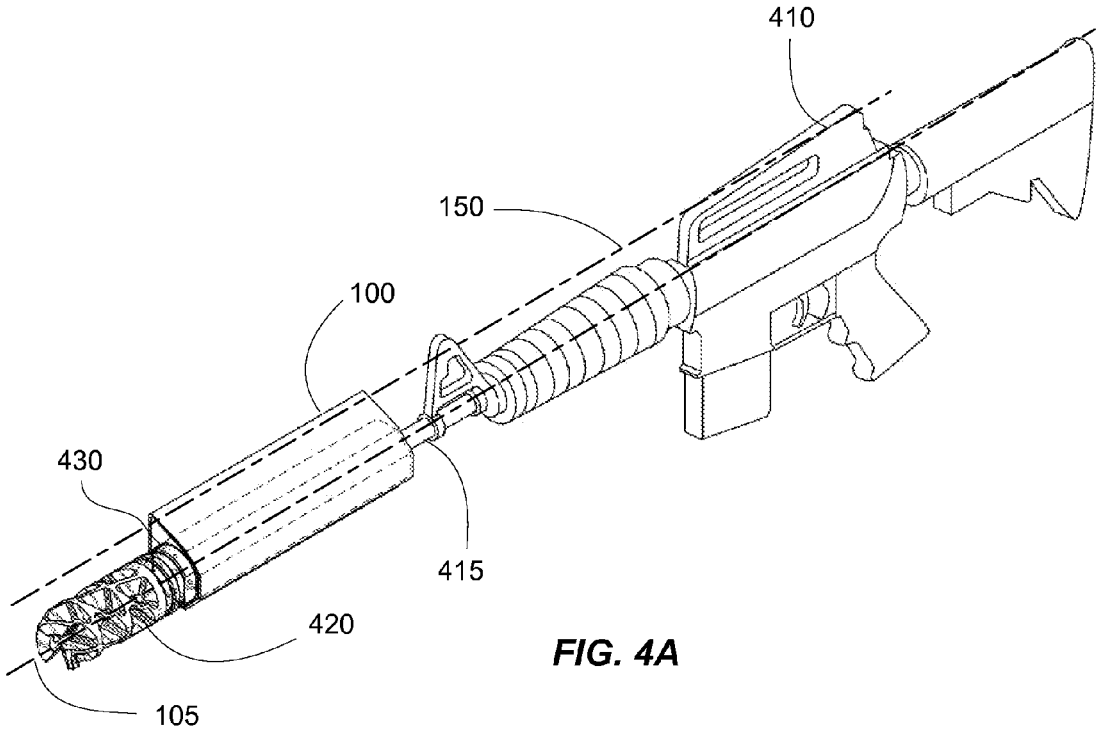
FIG. 4A is a perspective view of a modular assembly including a thermal mirage reducing sleeve in accordance with an aspect of the present invention.
Figure 4B:
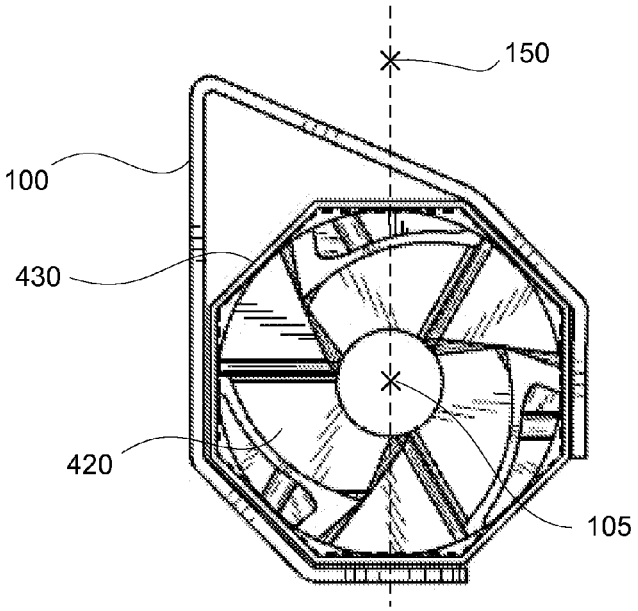
FIG. 4B is a front plan view of a modular assembly including a thermal mirage reducing sleeve in accordance with an aspect of the present invention.
Figure 5:
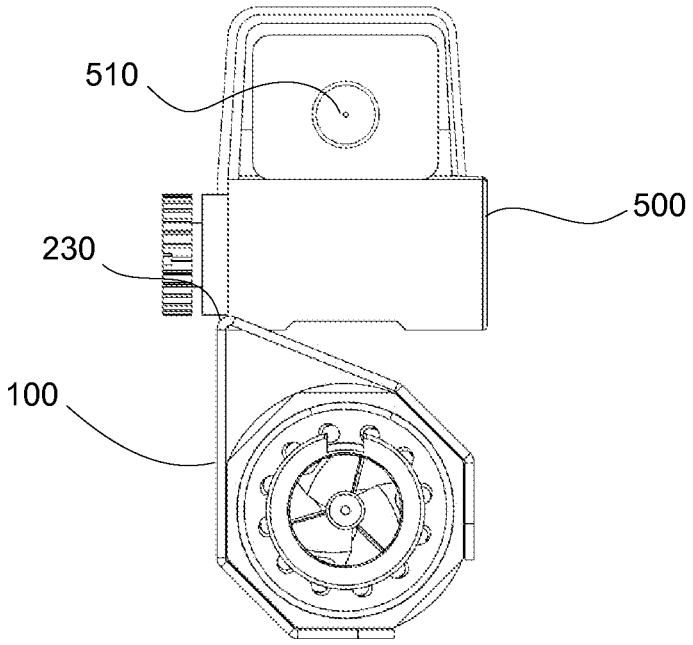
FIG. 5 is a front plan view of a reflex sight and a thermal mirage reducing sleeve oriented in locations as typically used in accordance with an aspect of the present invention.
Figure 6:
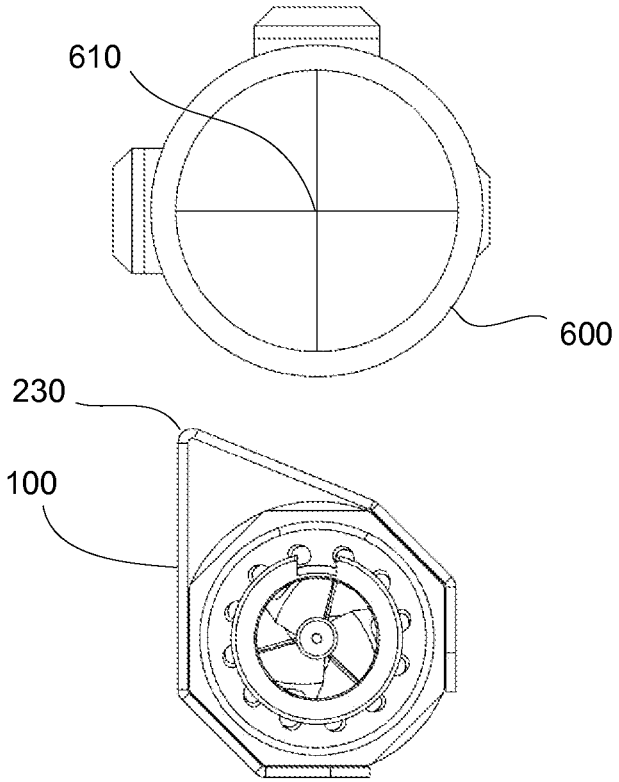
FIG. 6 is a front plan view of a scope and a thermal mirage reducing sleeve in relative locations as typically used in accordance with an aspect of the present invention.

An assembly can include a thermal mirage reducing device and a firearm associated with the heat control shell of the device such that the bore line of the firearm is coaxial with the longitudinal axis of the heat control shell. The assembly can also include additional units, such as a sound suppressor, energy capture system, particulate capture system, visual signature reducer, and other muzzle attachments. FIG. 4A-4B show an assembly with a firearm 410, a sound suppressor 430 attached to the barrel 415 of the firearm 410, a thermal mirage reducing sleeve 100 covering the sound suppressor 430, and a visual signature reducer 420 attached to the front of the sound suppressor. As shown, the bore line 105 of the firearm 410 is coaxial with the longitudinal axis of the sleeve. The sight line 150 of the firearm extends from the sights of the firearm parallel to the bore line. The high point of the heat-directing portion of the sleeve 100 is sufficiently laterally offset that a hot air plume rising vertically from the high point does not intersect the line of sight of the firearm. FIG. 5 and FIG. 6 show two examples of placement of a thermal mirage reducing sleeve in relation to two different types of firearm optics. FIG. 5 shows a holographic sight 500 and a thermal mirage reducing sleeve 100 in relative locations as assembled on a firearm. The line of sight in this case is at the center of the reticule 510. The high point 230 of the sleeve is to the side of the reticule so that the hot air plume will not interfere with the view of the shooter. Likewise, FIG. 6 shows a scope 600 and a sleeve 100, where the high point 230 of the sleeve is to the side of the center of the cross hairs 610 of the scope. As evident from the figures, the thermal mirage reducing sleeve can be effective when used with a variety of firearm sights and optics.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

What is claimed is:

1. A thermal mirage reducing device for firearms, comprising:

a heat control shell oriented along a horizontal longitudinal axis corresponding to a bore line of a firearm, wherein a cross-sectional profile of the heat control shell taken perpendicular to the longitudinal axis is asymmetrical about a vertical plane dividing the heat control shell along the longitudinal axis, wherein the cross-sectional profile comprises a heat-directing portion protruding on one side of the vertical plane and a core portion encompassing the longitudinal axis, wherein the heat-directing portion extends to a high point that is vertically higher than any other point in the cross-sectional profile and is laterally offset from the vertical plane, and wherein the cross-sectional profile does not intersect a line of sight of the firearm located parallel to the bore line and vertically above the cross-sectional profile.

2. The device of claim 1, wherein the cross-sectional profile is a teardrop profile wherein the high point is at a tapered tip of the teardrop and the heat-directing portion comprises a proximate edge and a distal edge which meet at the tapered tip of the teardrop, wherein the proximate edge is nearer to the line of sight than the distal edge.

3. The device of claim 2, wherein the cross-sectional profile is an arcuate teardrop profile, wherein the proximate edge is arcuate such that the proximate edge is concave recessed toward the distal edge.

4. The device of claim 2, wherein the cross-sectional profile is a straight-edged teardrop profile, wherein the proximate edge is substantially straight running from the tapered tip of the teardrop to the core portion.

5. The device of claim 2, wherein the heat control shell is adapted to be removably attachable to a firearm barrel or muzzle attachment, wherein the heat control shell comprises a distal face corresponding to the distal edge of the cross-sectional profile, and wherein the distal face includes a plurality of convective heat apertures into an interior space of the heat control shell.

6. The device of claim 2, wherein the heat control shell comprises a distal face corresponding to the distal edge of the cross-sectional profile, and wherein the distal face includes a plurality of heat transfer fins.

7. The device of claim 1, wherein the heat control shell is adapted to be removably attachable to a firearm barrel or muzzle attachment, and the heat control shell defines an interior space.

8. The device of claim 7, wherein the heat control shell comprises a slot oriented remote from the heat-directing portion of the heat control shell and running substantially parallel to the longitudinal axis along an entire length of the heat control shell.

9. The device of claim 7, wherein the interior space is configured in size and shape to form a friction fit with a firearm barrel or muzzle attachment.

10. The device of claim 7, wherein the interior space is configured in size and shape to receive a cylindrical muzzle attachment.

11. The device of claim 7, wherein the interior space is configured in size and shape to receive an octagonal muzzle attachment.

12. The device of claim 1, wherein the heat control shell is formed of a rigid material.

13. The device of claim 1, wherein the heat control shell comprises a thermally conductive material having a high thermal conductivity.

14. The device of claim 13, wherein the thermally conductive material is selected from the group consisting of aluminum, steel, copper, carbon fiber, composites thereof, alloys thereof, and mixtures thereof.

15. The device of claim 1, wherein the heat control shell is integrated with a firearm barrel or a muzzle attachment.

16. The device of claim 1, further comprising a firearm associated with the heat control shell such that the bore line of the firearm is coaxial with the longitudinal axis of the heat control shell.

17. The device of claim 16, wherein the high point of the heat-directing portion is sufficiently laterally offset that a hot air plume rising vertically from the high point does not intersect the line of sight of the firearm.

18. The device of claim 1, wherein the heat control shell is hinged.

19. The device of claim 1, further comprising a retention clip adapted to removably attach to the heat control shell and conformably restrain the heat control shell to promote a friction fit between the heat control shell and a firearm barrel or muzzle attachment.

20. The device of claim 1, further comprising an insulator layer disposed on an inside surface of the heat control shell above the longitudinal axis.

* * * * *